US009173809B2

(12) United States Patent
Honeyands

(10) Patent No.: US 9,173,809 B2
(45) Date of Patent: Nov. 3, 2015

(54) SHOWER ARRANGEMENT

(75) Inventor: Christopher Honeyands, Street (GB)

(73) Assignee: Keida Showers Limited, Winchester (GB)

( * ) Notice: Subject to any disclaimer, the term of this patent is extended or adjusted under 35 U.S.C. 154(b) by 184 days.

(21) Appl. No.: 12/740,980

(22) PCT Filed: Oct. 30, 2008

(86) PCT No.: PCT/GB2008/051019

§ 371 (c)(1), (2), (4) Date: Apr. 30, 2010

(87) PCT Pub. No.: WO2009/056887

PCT Pub. Date: May 7, 2009

(65) Prior Publication Data

US 2010/0252658 A1 Oct. 7, 2010

(30) Foreign Application Priority Data

Nov. 1, 2007 (GB) ..... 0721477.8

(51) Int. Cl.

| | |
|---|---|
| ***A61H 33/02*** | (2006.01) |
| ***B05B 7/04*** | (2006.01) |
| ***A45D 20/16*** | (2006.01) |
| *B05B 1/18* | (2006.01) |
| *B05B 7/16* | (2006.01) |
| *A61H 33/00* | (2006.01) |

(52) U.S. Cl.

CPC ..... *A61H 33/028* (2013.01); *A45D 20/16* (2013.01); *A61H 33/027* (2013.01); *B05B 7/045* (2013.01); *A61H 33/6036* (2013.01); *B05B 1/18* (2013.01); *B05B 7/1626* (2013.01)

(58) Field of Classification Search

CPC ..... A61H 33/6036; A61H 33/027; A61H 33/028; B05B 7/0475; B05B 7/0441; B05B 7/0416; B05B 7/045

USPC ..... 239/311, 318, 398, 592, 601, 14.2

See application file for complete search history.

(56) References Cited

U.S. PATENT DOCUMENTS

| | | | | |
|---|---|---|---|---|
| 2,026,743 | A * | 1/1936 | Kurtz | 239/594 |
| 3,281,864 | A | 11/1966 | Linnehan | |
| 3,774,843 | A * | 11/1973 | Rice | 239/14.2 |
| 3,965,494 | A * | 6/1976 | Baker | 4/615 |
| 4,103,827 | A * | 8/1978 | Kumazawa | 239/8 |
| 4,134,547 | A | 1/1979 | Gamst | |
| 4,426,040 | A | 1/1984 | Smith | |
| 4,903,895 | A * | 2/1990 | Mathewson et al. | 239/14.2 |
| 5,520,331 | A * | 5/1996 | Wolfe | 239/8 |
| 5,732,885 | A * | 3/1998 | Huffman | 239/416.5 |
| 7,523,876 | B2 * | 4/2009 | Wolfe | 239/581.1 |
| 2002/0000477 | A1 * | 1/2002 | Hara | 239/104 |

FOREIGN PATENT DOCUMENTS

| | | |
|---|---|---|
| DE | 19813366 A1 | 10/1998 |
| GB | 329157 | 5/1930 |
| JP | 9-262512 A | 10/1997 |

(Continued)

*Primary Examiner* — Jason Boeckmann

(74) *Attorney, Agent, or Firm* — Fay Sharpe LLP

(57) ABSTRACT

Shower apparatus comprises a shower head (1) for expelling fluid in use, means (2) for connecting the shower head (1) to a water supply (3), a pressurized air supply (4), and guidance means (5) for guiding air flow from the pressurized air supply (4) to the shower head (1).

19 Claims, 3 Drawing Sheets

(56) References Cited

FOREIGN PATENT DOCUMENTS

Figure 1:
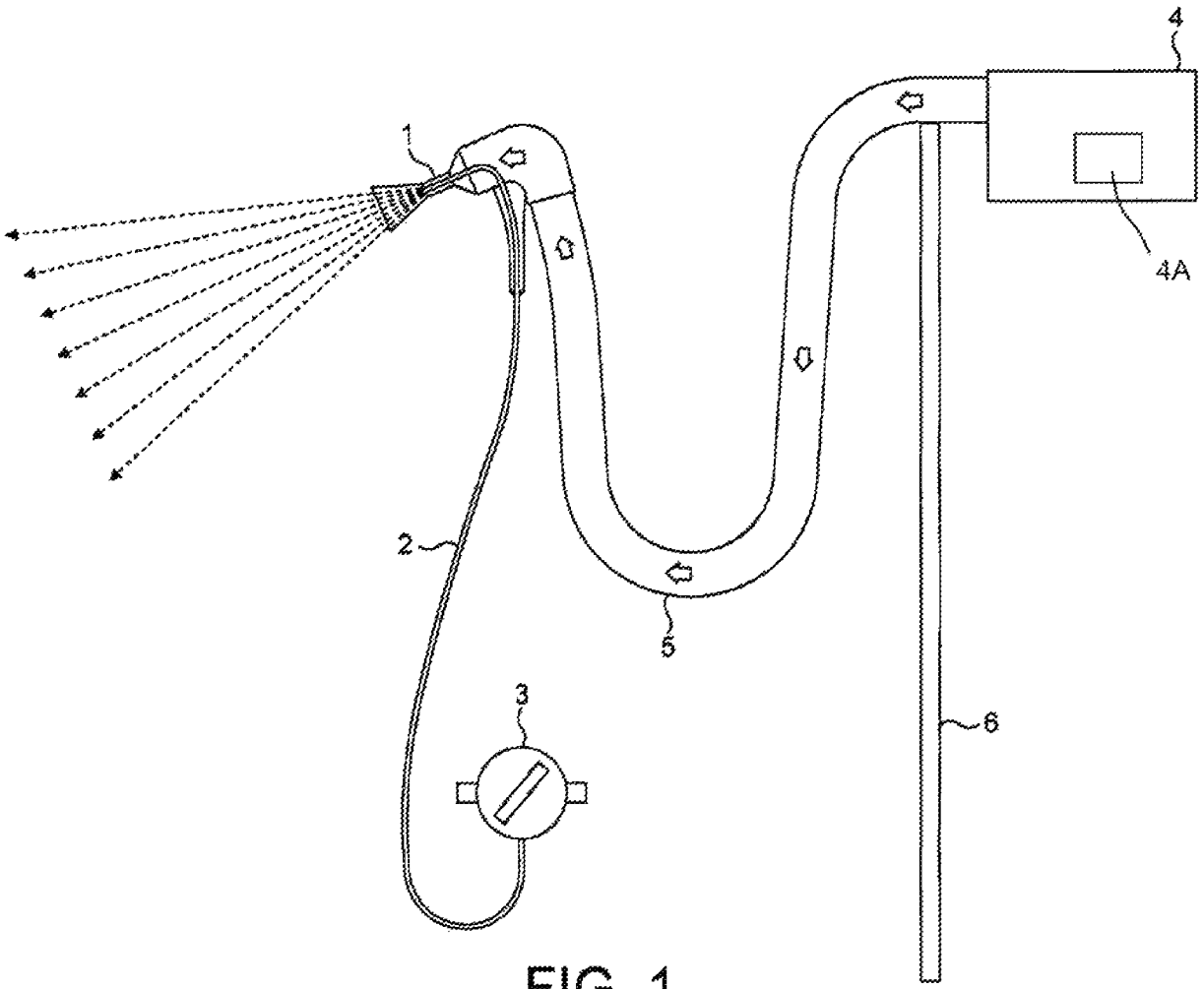

| | | | |
|---|---|---|---|
| JP | 2000237082 | A | 9/2000 |
| JP | 2001149252 | A | 6/2001 |
| JP | 2002-119435 | A | 4/2002 |
| JP | 2006-116518 | A | 5/2006 |
| JP | 2007326082 | A | 12/2007 |
| JP | 4-122227 | A | 4/2010 |

* cited by examiner

SHOWER ARRANGEMENT

This invention relates to shower apparatus and a shower head for use with such apparatus.

Typically, showers, for example for domestic use, comprise a shower head connected to a water supply. The supply may be provided specifically for the shower, or alternatively a shared source may be used, for example by connecting pipes to the taps of a bath. The shower head is typically adapted to provide a spray of water. It is known for shower heads to include venturi sections to increase the velocity of the through-flowing water to provide a stronger spray. In addition, some shower heads are adjustable, to change the spray pattern to suit the user's preference. Furthermore, some shower heads enable ambient air in the vicinity of the shower head to be drawn into the shower head to mix with the water flowing through. This may be used to create a foam effect, whereby the water contains small bubbles of air trapped within it. In such devices, the air may be drawn or sucked in by creating a region of low pressure inside the shower head, which may be effected by passing the water through a venturi similar to that described above. As the water velocity increases, the pressure is reduced, so that air may be drawn in in the region of the venturi, for example through gaps in the body of the shower head. Such an arrangement has an incidental effect of reducing the amount of water needed to shower effectively, as the air bubbles entrained in the water increase the volume of fluid flowing out of the shower head. This reduction in water usage is advantageous for two reasons—firstly by reducing the environmental and financial impact of water use, and secondly by reducing the amount of energy needed to heat the water to an acceptable level for a user of the shower. However, while this reduction in the amount of water is advantageous, the reduction is slight.

It is an aim of the present invention to provide shower apparatus which enables the volume of water necessary for an effective shower to be greatly reduced. This aim is achieved by providing shower apparatus by which pressurised air can be blown into the shower head for mixing with the water flow.

It is a further aim of the present invention to provide shower apparatus which permits simple in-situ drying of a user of the shower. This aim is achieved by enabling pressurised air to be blown through the shower head in the absence of water.

Shower apparatus in accordance with the present invention provides a shower experience similar to that of a conventional "power shower", despite requiring much reduced power and water.

In accordance with a first aspect of the present invention, there is provided shower apparatus as set out in the accompanying claims.

In accordance with a second aspect of the present invention, there is provided a shower head as set out in the accompanying claims.

Apparatus in accordance with the present invention has various benefits and advantages over known systems. These include:

1) The volume of water needed for an effective shower is dramatically reduced. A typical mixer shower requires in the order of 15-20 liters of water per minute, while a shower incorporating the inventive apparatus may only require in the order of 2-5 liters per minute.

2) The total energy required for an effective shower is reduced. This primarily arises because there is less water to be heated. Even when the energy required to supply pressurized, optionally heated air is taken into account, the net energy usage is still reduced. The invention may have a water usage of about 3 liters/minute, compared with a conventional domestic shower's usage of about 15 liters/minute, i.e. about an 80% water saving. Furthermore, an energy saving of about 79% is achievable over the same conventional shower.

This energy saving provides a further advantage in that the electrical power required could be taken from a domestic ring main, rather than having to use a dedicated high current power line which is typically required by existing electric shower units.

3) A reduction in the water pressure needed for operation. The apparatus will work effectively even if the water is simply gravity-fed from immediately above the shower head. An ingoing water flow rate of just 3 liters per minute is sufficient for effective shower operation.

4) Unlike a conventional shower, which has many spray orifices which tend to block in hard water areas, in certain embodiments the inventive apparatus may use a large water pipe (typically about 8 mm diameter) for the shower fluid output.

5) The apparatus may be retrofitted to existing shower system or alternatively integrated into a new system.

6) The apparatus may be used to dry a user immediately after the shower.

7) Mould formation on and in the shower head is reduced.

Figure 2:
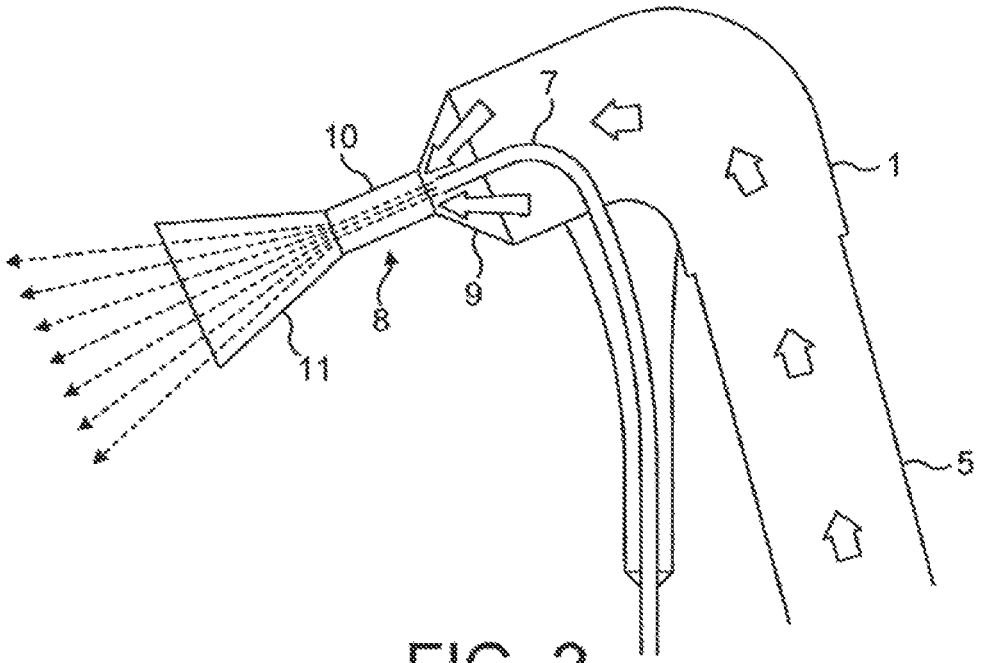
Figure 3:
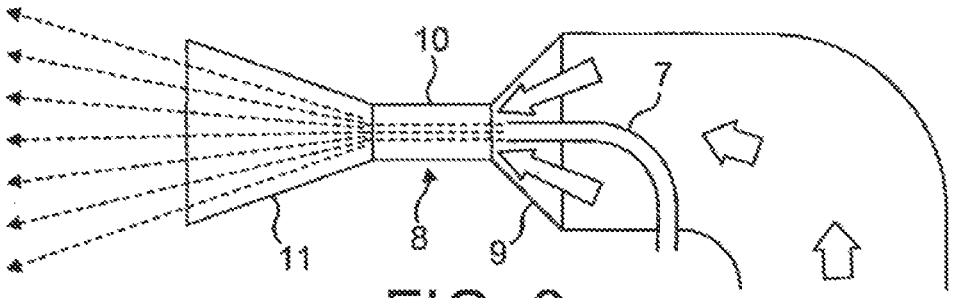
Figure 4:
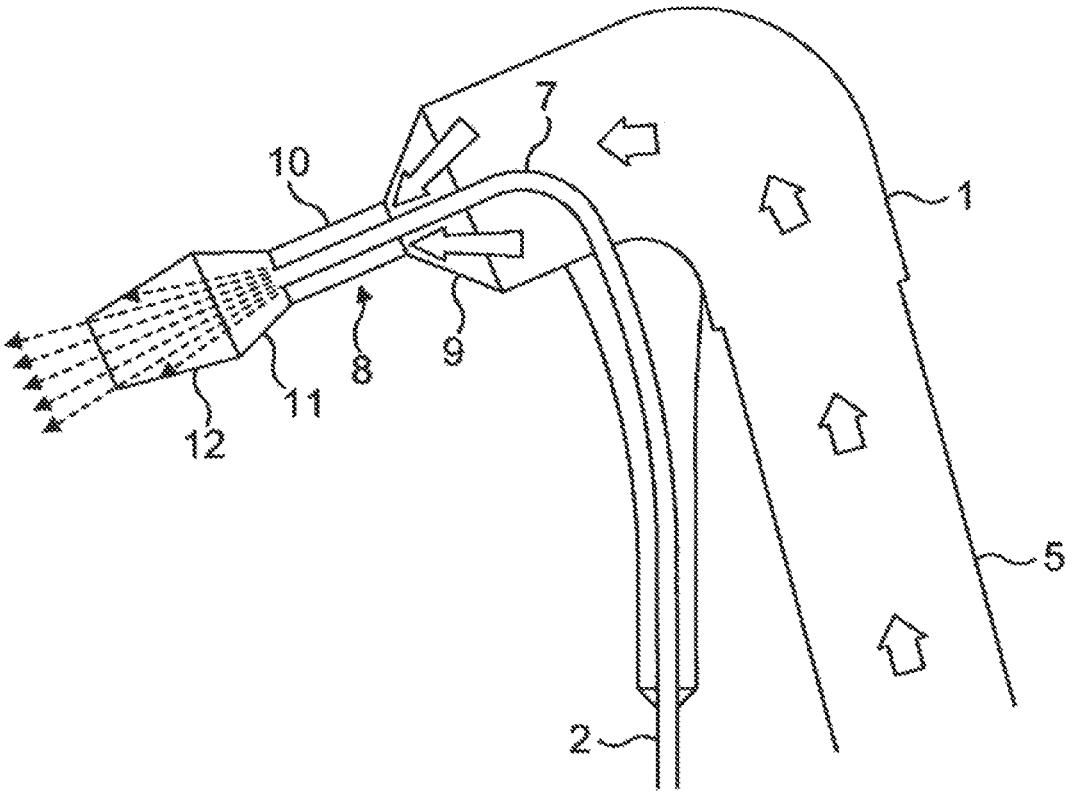

The invention will now be described, by way of example, with reference to the accompanying drawings, in which:

FIG. 1 schematically shows shower apparatus in accordance with a first embodiment of the present invention installed in a shower enclosure;

FIG. 2 shows a cross section of the apparatus of FIG. 1;

FIG. 3 schematically shows the operation of the shower head of FIG. 1; and FIG. 4 schematically shows shower apparatus in accordance with a second aspect of the present invention.

FIG. 1 shows a first embodiment of the present invention in a domestic shower enclosure. A shower head 1, for example made from a plastics material or a chromed metal, is fluidly connected via a flexible water pipe 2 to a water supply 3, in this case a water mixer tap. The shower head 1 is also in fluid communication with a pressurised air supply 4, such as an air pump or blower, via flexible air ducting 5. In the embodiment shown, the air supply 4 is located on a wall outside the enclosure, so that the ducting 5 enters the enclosure by passing over a shower screen 6. Heating means 4A may be provided along the air flow path, for example at the air supply 4, in order to warm the air supplied to the shower head 1.

Part of the apparatus of FIG. 1 is shown in more detail in FIG. 2, with the shower head 1 shown in cross-section. The shower head 1 has, formed within it, a water inlet pipe 7 connected to the flexible pipe 2. The water inlet pipe is rigidly formed so that the position and orientation of the pipe end can be accurately set. For example, the inlet pipe may be formed as a metal or plastics tube, or may be formed by moulding within the shower head 1.

The rear of shower head 1 is connected to ducting 5, so that an air flow, shown by the arrows on FIG. 2, can flow through the shower head 1 and out of the front of the shower head.

A portion of the shower head 1 forms a venturi 8 in the air flow path. This has a convergent region 9 with an internal diameter which decreases in the direction of air flow, a throat region 10 located after the convergent region 9 in the direction of air flow which has a reduced internal diameter which is substantially constant along its length, and a divergent region 11 with an internal diameter which increases in the direction of air flow.

The shower head venturi 8 is shown in more detail in FIG. 3. Here it can be seen clearly that in this embodiment, the water inlet pipe 7 opens inside the convergent region 9, centred within the air flow and substantially parallel thereto.

In the embodiment shown, unlike conventional shower heads, no shower "rose" (i.e. a plate with a pattern of holes or spray orifices formed therein) is used to create a spray. Instead, a satisfactory spray pattern is produced due to the configuration of the divergent region 11.

FIG. 4 shows a second embodiment of the present invention. This embodiment is generally similar to that shown in FIGS. 1-3, and thus like reference numerals are retained as far as possible, but has two important differences. Firstly, a second convergent region 12, having an internal diameter that decreases in the direction of air flow, is located after the divergent region 11 in the direction of air flow. In this case, the second convergent region 12 acts as a nozzle, speeding up the fluid (now comprising droplets of water in air) flow therethrough. This leads to a stronger and more even spray, with reduced noise.

Secondly, the water inlet pipe 7 opens in, and thus acts to introduce water to, the divergent region 11 of the venturi 8. In the divergent region, the cross-sectional area of the air flow path expands in the direction of air flow. This means that the air pressure in the divergent region 11 is lower than in either the convergent region 9 or throat region 10, where the air flow path cross-sectional area is reducing or constant respectively. Therefore, providing the water inlet pipe opening at the divergent region 11 aids the introduction of water to the air flow path in comparison to the throat or convergent regions. In fact, positioning the water inlet pipe opening at the divergent region acts to suck water out of the pipe. This effect is particularly beneficial in situations where the water pressure is relatively low, for example in gravity-fed water systems.

The apparatus described may operate in three different modes, depending on which of the air and water supplies are selected to supply fluid to the shower head:

1) Air+Water (Normal Shower Operation)

The basic mode of operation is to have both the air 4 and water 3 supplies feeding fluid to the shower head 1. Air is guided under pressure to the shower head 1 through ducting 5. As it is forced through the convergent region 9 of venturi 8, the air's velocity is increased and its pressure reduced. Meanwhile, water enters the base of the shower head 1 from flexible water pipe 2, with sufficient pressure to cause it to flow from the opening of inlet pipe 7. The water is mixed with the high velocity air in the throat 10 of the venturi 8 and kinetic energy is transferred from the air to the water. The water and air exit through the divergent region 11. Here, the air and water slow and expand into a greater area, thus forming a spray of droplets within a lower velocity shower.

2) Air Only (Drying)

In a second mode, the water supply 3 may be switched off by a user, so that only air is passed through the shower head 1. If a heating means is provided, the air may be heated to a suitable temperature before exiting the shower head 1. This enables the user to be dried by the air flow before stepping out of the shower. An additional benefit if that the inside of the shower head is dried, reducing the formation of mould.

3) Water Only

In the third mode of operation, the water supply is switched on, but the air supply is turned off. This mode may be used where a greater volume of water is needed, for example if the user is using the shower to fill a bath.

The above described apparatus is exemplary only, and various possibilities and alternatives are possible within the scope of the claims.

The water supply may for example be provided at a higher level than the shower head, so that the water is gravity-fed to the shower head.

The air supply may be used to recirculate air from the shower area. The air and water supplies may be combined into a single unit. Controls to effect switching of the air and/or water supplies, or to control the heating means, may be provided on the shower head itself with the inclusion of appropriate electronics.

The shower head may be fixed to a wall, in which case any ducting would be hidden within the wall. The air supply may be housed with a cupboard or roof space for example.

The water could be introduced at any region of the air flow path including and upstream of the divergent region of the venturi. Furthermore, the dimensions and angles of the venturi may be adjusted to alter the spray pattern, volume of water used and efficiency of the shower head.

In addition, the water inlet pipe 7 could have different forms, for example at least one orifice, e.g. eight, may be provided around the perimeter of the pipe so that the water comes out laterally, before being propelled forward by the air flow.

The invention claimed is:

1. A shower producing apparatus for use by a user, comprising:

a shower head, an air supply means, and a water supply means;

the shower head including a main passageway and a water passageway;

the main passageway forming an air flow path leading from an air inlet through a venturi, the venturi having a convergent region, throat and divergent region, towards a shower outlet;

the water passageway leading from a water inlet to a water discharge port disposed within the venturi in or upstream of the divergent region and downstream of a transition between the convergent region and the throat;

wherein the air supply means is arranged to supply pressurised air to the air inlet so that, in use, an air stream flows in an air flow direction through the venturi from the convergent region via the throat and the divergent region to the shower outlet and is discharged from the shower outlet;

the venturi is arranged to constrict the air flow path so as to accelerate the air stream as it passes through the convergent region to a first, relatively high velocity in the throat; and the water supply means is arranged to supply water to the water inlet so that, in use, water is discharged from the discharge port into the air stream and breaks up within the venturi to form a spray of water droplets carried in the air stream, and the air stream carrying the spray of water droplets is decelerated in the divergent region so that the water droplets exit the venturi at a second, relatively lower velocity and are discharged with the air stream from the shower outlet as a shower of said droplets which were formed within the venturi in which the user may shower;

wherein the water discharge port is arranged to discharge the water into the air flow in the venturi centrally with respect to the cross-section of the air flow at the point of discharge of the water discharge port; and wherein the main passageway has a second convergent region disposed downstream of the divergent region of the venturi and arranged to accelerate the air stream carrying the spray of water droplets as it flows through the second convergent region towards the shower outlet.

2. An apparatus according to claim 1, wherein:
the water discharge port is disposed in the venturi upstream in the air flow direction from the divergent region of the venturi.

3. An apparatus according to claim 1, wherein:
the water discharge port is disposed in the venturi within or downstream of a constant diameter section of the throat of the venturi.

4. An apparatus according to claim 1, wherein:
the water discharge port is arranged to discharge the water into the air flow in the venturi in substantially the same direction as the air flow adjacent the discharge port.

5. An apparatus according to claim 1, wherein:
the shower head has a single such shower outlet.

6. An apparatus according to claim 1, wherein:
the shower head is devoid of a rose at its outlet.

7. An apparatus according to claim 1, further including:
means for heating the air supplied to the shower head.

8. An apparatus according to claim 1, wherein:
fluid expelled by the shower head in use is selectable by a user to comprise water, air or a mixture of water and air.

9. An apparatus according to claim 1, wherein the shower outlet is an outlet of the second convergent region.

10. A shower producing apparatus for use by a user, comprising:
a shower head, an air supply means, and a water supply means;
the shower head including a main passageway and a water passageway;
the main passageway forming an air flow path leading from an air inlet through a venturi, the venturi having a convergent region, throat and divergent region, towards a shower outlet;
the water passageway leading from a water inlet to a water discharge port disposed within the venturi in or upstream of the divergent region;
wherein the air supply means is arranged to supply pressurised air to the air inlet so that, in use, an air stream flows in an air flow direction through the venturi from the convergent region via the throat and the divergent region to the shower outlet and is discharged from the shower outlet;
wherein the venturi is arranged to constrict the air flow path so as to accelerate the air stream as it passes through the convergent region to a first, relatively high velocity in the throat; and
wherein the water supply means is arranged to supply heated water to the water inlet so that, in use, the heated water is discharged from the discharge port into the air stream and breaks up within the venturi to form a spray of water droplets carried in the air stream, and the air stream carrying the spray of water droplets is decelerated in the divergent region so that the water droplets exit the venturi at a second, relatively lower velocity and are discharged with the air stream from the shower outlet as a generally circular shower of said droplets which were formed within the venturi in which the user may shower; and
wherein the main passageway has a second convergent region disposed downstream of the divergent region of the venturi and arranged to accelerate the air stream carrying the spray of water droplets as it flows through the second convergent region towards the shower outlet.

11. An apparatus according to claim 10, wherein the shower outlet is an outlet of the second convergent region.

12. An apparatus according to claim 10, wherein the water discharge port is disposed within or downstream of a constant diameter section of the throat of the venturi.

13. A shower head for use by a user, comprising:
a main passageway forming an air flow path leading from an air inlet through a venturi, the venturi having a convergent region, throat and divergent region, towards a shower outlet so that, when the air inlet is connected to a supply of pressurised air, an air stream flows from the air inlet in an air flow direction through the venturi from the convergent region via the throat and the divergent region to the shower outlet;
the venturi being arranged to constrict the air flow path so that the air stream is accelerated as it passes through the convergent region to a first, relatively high velocity in the throat; and
a water passageway leading from a water inlet to a water discharge port disposed within the venturi in or upstream of the divergent region and downstream of a transition between the convergent region and the throat so that, when the water inlet is connected to a supply of water:
water flows from the water inlet through the water passageway to the discharge port and is discharged into the air stream, and breaks up within the venturi to form a spray of water droplets carried in the air stream; and
the air stream carrying the spray of water droplets is decelerated in the divergent region so that the water droplets exit the venturi at a second, relatively lower velocity and are discharged with the air stream from the shower outlet as a shower of said droplets which were formed within the venturi in which the user may shower;
wherein the water discharge port is arranged to discharge the water into the air flow in the venturi centrally with respect to the cross-section of the air flow at the point of discharge of the water discharge port; and
wherein the main passageway has a second convergent region disposed downstream of the divergent region of the venturi and arranged to accelerate the air stream carrying the spray of water droplets as it flows through the second convergent region towards the shower outlet.

14. A method for producing from a shower head a shower of water droplets in which a user may shower, comprising:
providing in the shower head an air flow path leading from an air inlet through a venturi, the venturi having a convergent region, throat and divergent region, towards a shower outlet;
supplying pressurised air to the air inlet so that an air stream flows from the air inlet along the air flow path in an air flow direction through the venturi from the convergent region via the throat and divergent region to the shower outlet;
accelerating the air stream as it passes through the convergent region to a first, relatively high velocity in the throat;
discharging water from a water discharge port into the air stream within the venturi in or upstream of the divergent region and downstream of a transition between the convergent region and the throat and centrally with respect to the cross-section of the air flow at the point of discharge of the water discharge port so that the water breaks up within the venturi into a spray of droplets carried in the air stream;
decelerating the air stream carrying the spray of water droplets in the divergent region so that the water droplets exit the venturi at a second, relatively lower velocity; and discharging the water droplets as a shower of said droplets which were formed within the venturi, said droplets being carried in the air stream from the shower outlet;

wherein the main passageway has a second convergent region disposed downstream of the divergent region of the venturi, and the air stream carrying the spray of water droplets is accelerated as it flows through the second convergent region towards the shower outlet.

15. A method according to claim 14, wherein:

the shower outlet is an outlet of the second convergent region, and the water droplets are discharged as a shower of said droplets from the outlet of the second convergent region.

16. A method according to claim 14, including:

discharging the water from the water discharge port into the air stream at a position in the venturi upstream in the air flow direction from the divergent region of the venturi.

17. A method for producing from a shower head a shower of water droplets in which a user may shower, comprising:

providing in the shower head an air flow path leading from an air inlet through a venturi, the venturi having a convergent region, throat and divergent region, towards a shower outlet;

supplying pressurised air to the air inlet so that an air stream flows from the air inlet along the air flow path in an air flow direction through the venturi from the convergent region via the throat and divergent region to the shower outlet;

accelerating the air stream as it passes through the convergent region to a first, relatively high velocity in the throat;

discharging heated water from a water discharge port into the air stream within the venturi in or upstream of the divergent region so that the heated water breaks up within the venturi into a spray of droplets carried in the air stream;

decelerating the air stream carrying the spray of water droplets in the divergent region so that the water droplets exit the venturi at a second, relatively lower velocity; and discharging the water droplets as a shower of said droplets which were formed within the venturi, said droplets being carried in the air stream from the shower outlet; and wherein the air flow path includes a second convergent region disposed downstream of the divergent region of the venturi for reducing noise emitted from the shower head in use, and the air stream carrying the spray of water droplets is accelerated as it flows through the second convergent region towards the shower outlet.

18. A method according to claim 17, wherein:

the shower outlet is an outlet of the second convergent region, and the water droplets are discharged as a shower of said droplets from the outlet of the second convergent region.

19. A method according to claim 17, including:

discharging the water from the water discharge port into the air stream at a position in the venturi downstream in the air flow direction from the convergent region of the venturi.

* * * * *